US007048578B2

(12) United States Patent
Rodrigues

(10) Patent No.: US 7,048,578 B2
(45) Date of Patent: May 23, 2006

(54) TOOLESS COAXIAL CONNECTOR

(75) Inventor: Julio F. Rodrigues, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 10/960,559

(22) Filed: Oct. 6, 2004

(65) Prior Publication Data

US 2005/0079761 A1 Apr. 14, 2005

Related U.S. Application Data

(60) Provisional application No. 60/511,019, filed on Oct. 14, 2003.

(51) Int. Cl.
*H01R 9/05* (2006.01)

(52) U.S. Cl. ..... 439/578; 439/584

(58) Field of Classification Search ..... 439/578–585, 439/805–807, 851, 274–275, 675, 752, 357, 439/351–352, 395, 404, 783–784
See application file for complete search history.

(56) References Cited

U.S. PATENT DOCUMENTS

| | | | | |
|---|---|---|---|---|
| 2,711,520 | A | | 6/1955 | Kernen |
| 3,517,112 | A | | 6/1970 | Wahl |
| 3,646,502 | A | | 2/1972 | Hutter et al. |
| 3,744,007 | A | | 7/1973 | Horak |
| 3,977,752 | A | | 8/1976 | Freitag |
| 4,284,321 | A | | 8/1981 | Detemple et al. |
| 4,339,166 | A | | 7/1982 | Dayton |
| 4,761,146 | A | | 8/1988 | Sohoel |
| 4,902,246 | A | | 2/1990 | Samchisen |
| 4,952,174 | A | | 8/1990 | Sucht et al. |
| 5,002,503 | A | | 3/1991 | Campbell et al. |
| 5,007,861 | A | | 4/1991 | Stirling |
| 5,011,432 | A | * | 4/1991 | Sucht et al. ..... 439/584 |
| 5,052,946 | A | | 10/1991 | Homolka |
| 5,281,167 | A | | 1/1994 | Le et al. |
| 5,389,012 | A | | 2/1995 | Huang |
| 5,393,244 | A | | 2/1995 | Szegda |
| 5,435,745 | A | * | 7/1995 | Booth ..... 439/584 |
| 5,620,339 | A | * | 4/1997 | Gray et al. ..... 439/578 |
| 5,632,651 | A | | 5/1997 | Szegda |
| 5,651,698 | A | | 7/1997 | Locati et al. |
| 5,769,662 | A | | 6/1998 | Stabile et al. |
| 5,803,767 | A | | 9/1998 | Matsumoto et al. |
| 6,027,373 | A | | 2/2000 | Gray et al. |
| 6,123,581 | A | | 9/2000 | Stabile et al. |

(Continued)

*Primary Examiner*—P. Austin Bradley
*Assistant Examiner*—Edwin A. Leon
(74) *Attorney, Agent, or Firm*—Hoffmann & Baron, LLP

(57) ABSTRACT

The present invention is a tooless connector for mounting on a straight cut end of a coaxial shielded type cable. The connector can have a cylindrical housing with a first end for receiving the coaxial shielded cable and an oppositely positioned second end. A rear wall can be positioned in the interior of the cylindrical housing forming an abutment for the insertion of the coaxial cable. A terminal assembly including a ferrule assembly having at least one prong extending therefrom is positioned through the rear wall. The prong is positioned to contact a foil layer and/or a braided layer of the coaxial cable. A terminal extends through the center of the ferrule for receiving the center of the coaxial cable. A compression assembly is attached to the cylindrical housing to securely hold the coaxial cable after it has been inserted into the connector.

20 Claims, 3 Drawing Sheets

U.S. PATENT DOCUMENTS

| | | | | |
|---|---|---|---|---|
| 6,146,208 | A | 11/2000 | Pennell | |
| 6,153,830 | A | 11/2000 | Montena | |
| 6,210,222 | B1 | 4/2001 | Langham et al. | |
| 6,261,126 | B1 | 7/2001 | Stirling | |
| 6,331,123 | B1 | 12/2001 | Rodrigues | |
| 6,350,146 | B1 | 2/2002 | Su | |
| 6,352,444 | B1 | 3/2002 | Yuzawa | |
| 6,372,991 | B1 | 4/2002 | Myers | |
| 6,386,915 | B1 | 5/2002 | Nelson | |
| 6,848,939 | B1 * | 2/2005 | Stirling | 439/578 |

* cited by examiner

TOOLESS COAXIAL CONNECTOR

CROSS-REFERENCE TO RELATED APPLICATIONS

This application claims the benefit of U.S. Provisional Application No. 60/511,019 filed on Oct. 14, 2003 the disclosure of which is incorporated herein by reference.

BACKGROUND OF THE INVENTION

The present invention relates generally to a coaxial connector and more particularly to a tooless coaxial connector for a coaxial cable.

Prior art coaxial connectors require a coaxial cable to be prepared by exposing the center conductor and the outer conductor. In addition, after the cable is inserted into the connector a special compression tool must be used to then attach the connector to the cable.

Typical coaxial cables have a center conductor which is surrounded by a dielectric layer usually made of a foam material. Covering the dielectric layer is a metallic foil coating which is then surrounded by a metallic braid. The braid is then covered by an outer jacket made of an insulating material. A problem with current coaxial connectors is that in order to properly attach the connector to the cable, the cable end must be stripped and prepared. Specifically, the outer conductor, namely, the foil, and the center conductor must be exposed so that the coaxial connector can make an electrical connection with the two parts. In addition, the braid surrounding the foil must be folded back over the outer jacket so that the connector can properly attach to the foil and braid. The coaxial cable is then inserted into the connector. The final step in assembling the connector is crimping the connector over the outer jacket of the cable to hold it in place.

A problem associated with current coaxial connectors is that the steps of stripping the cable end are time consuming and require some training to do properly. In addition, the coaxial connector requires the use of a specialized crimping tool which increases the time and expense of using the coaxial connector.

There exists a need for a coaxial connector that eliminates the extensive preparation time needed to prepare the coaxial cable for use with the coaxial connector. There is also a need for a connector that can be attached and removed from the coaxial cable without the use of any specialized tool.

Finally, there exists a need for a coaxial connector that can be used by a person that does not require extensive training.

SUMMARY OF THE INVENTION

The present invention is a tooless coaxial connector having a housing with a first end for receiving a coaxial shielded cable with a straight cut end. In a preferred embodiment, the housing has a cylindrical shape. The first end has an inner diameter that is larger than the outer diameter of the cable and is preferably sized so that there is minimal play between the inner diameter of the first end and the outer diameter of the coaxial shielded cable. The cylindrical housing has an oppositely positioned second end with a passageway to the first end. A rear wall is positioned in the interior of the cylindrical housing that forms an abutment that stops the insertion of the coaxial cable. A terminal assembly is positioned through an aperture in the rear wall of the cylindrical housing to engage the coaxial cable when inserted into the cylindrical housing. A compression assembly is preferably positioned at the first end of the cylindrical housing to selectively removably hold the coaxial cable in the cylindrical housing after it is inserted into the first end.

In a preferred embodiment, the terminal assembly includes a ferrule assembly that extends through an aperture in the rear wall towards the interior of the housing and the first end. The ferrule assembly is preferably made in a two-piece arrangement having a body flange and a ferrule. The ferrule has at least one prong extending therefrom and is positioned radially from the center of the ferrule. The at least one prong is positioned to extend between the foil layer and the braid layer of the coaxial cable. The ferrule is sized to fit within a center aperture of a flange body that is inserted into the second end of the cylindrical housing. The terminal assembly can also include a terminal extending through the center of the ferrule. The terminal has a first end extending through the ferrule toward the first end of the housing and a second end extending towards the second end of the housing. The first end is positioned to receive the center of the coaxial cable. In a preferred embodiment, the terminal has a hollow portion that is sized to receive the center conductor of the coaxial cable and can be made with at least one spring contact of a resilient metallic material.

In a preferred embodiment, the compression assembly can include at least one resilient tab integrally formed with the first end of the housing. The at least one resilient tab has an inner surface having a barb extending therefrom for frictionally contacting the outer surface of the coaxial cable after it is inserted into the first end. The first end can have a threaded portion that is on the exterior of the housing. A lock ring is adapted to engage the threaded portion to compress the at least one resilient tab against the coaxial cable when it is inserted into the housing to securely grip the coaxial cable in place.

In a more preferred embodiment, the compression assembly further includes a compression ring positioned between the outer surface of the first end and the lock ring. At least one compression sealing ring is positioned between the compression ring and the lock ring so that when the lock ring is tightened onto the first end the lock ring and the compression ring will compress the compression sealing ring so that a fluid tight seal is created between the compression sealing ring and the coaxial cable.

The present invention provides a tooless coaxial connector that can be used on coaxial shielded cables without the need for special preparation of a straight cut end of the coaxial shielded cable.

The present invention allows the tooless coaxial connector to be attached without the use of any specialized tools.

The present invention also allows for the coaxial cable to be held securely within the tooless coaxial connector to prevent the coaxial cable from being inadvertently pulled out of the tooless coaxial connector.

The present invention is constructed to have a lock ring that securely holds the tooless coaxial connector on the cut end of the coaxial shielded cable to prevent unwanted removal.

The present invention can be easily attached without extensive training to further lower the cost of using the connector.

The present invention can be easily removed from the coaxial shielded cable and transferred to another coaxial shielded cable.

DETAILED DESCRIPTION OF THE PREFERRED EMBODIMENT

Figure 1:
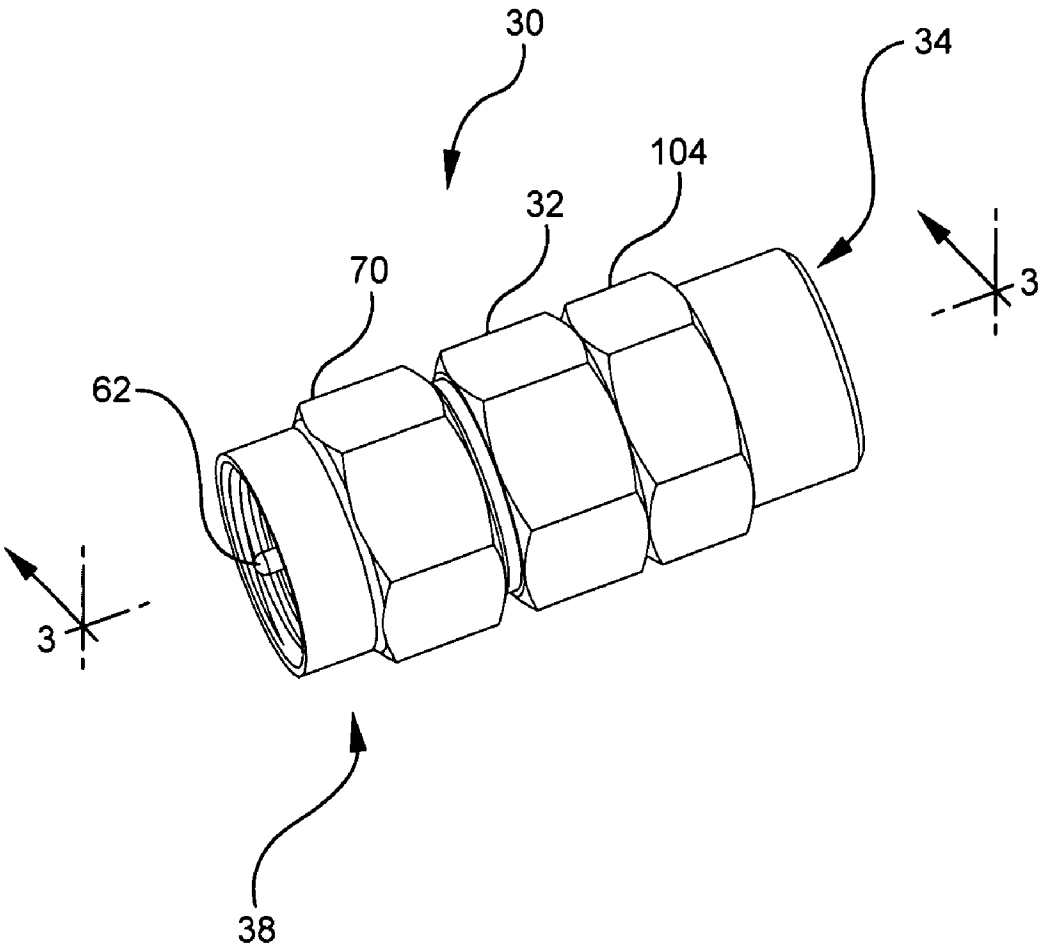
FIG. 1 is an assembled view of the present invention.

Referring to FIG. 1 a tooless coaxial connector 30 in accordance with the present invention is shown. The connector 30 has a housing 32 having a first end 34 and a lock ring 104 which accepts a cable (not shown). Positioned opposite the first end 34 is a second end 38 having a first nut 70 used to attach the connector 30 to the desired mating device (not shown). The connector 30 is shown fully assembled and is a compact design that does not require any specialized tools to attach either the mating device or the coaxial cable. The housing 32, first nut 70, and lock ring 104 can have a hexagonal outer profile to allow the use of a box wrench or open wrench to tighten the various parts of the connector 30.

Figure 2:
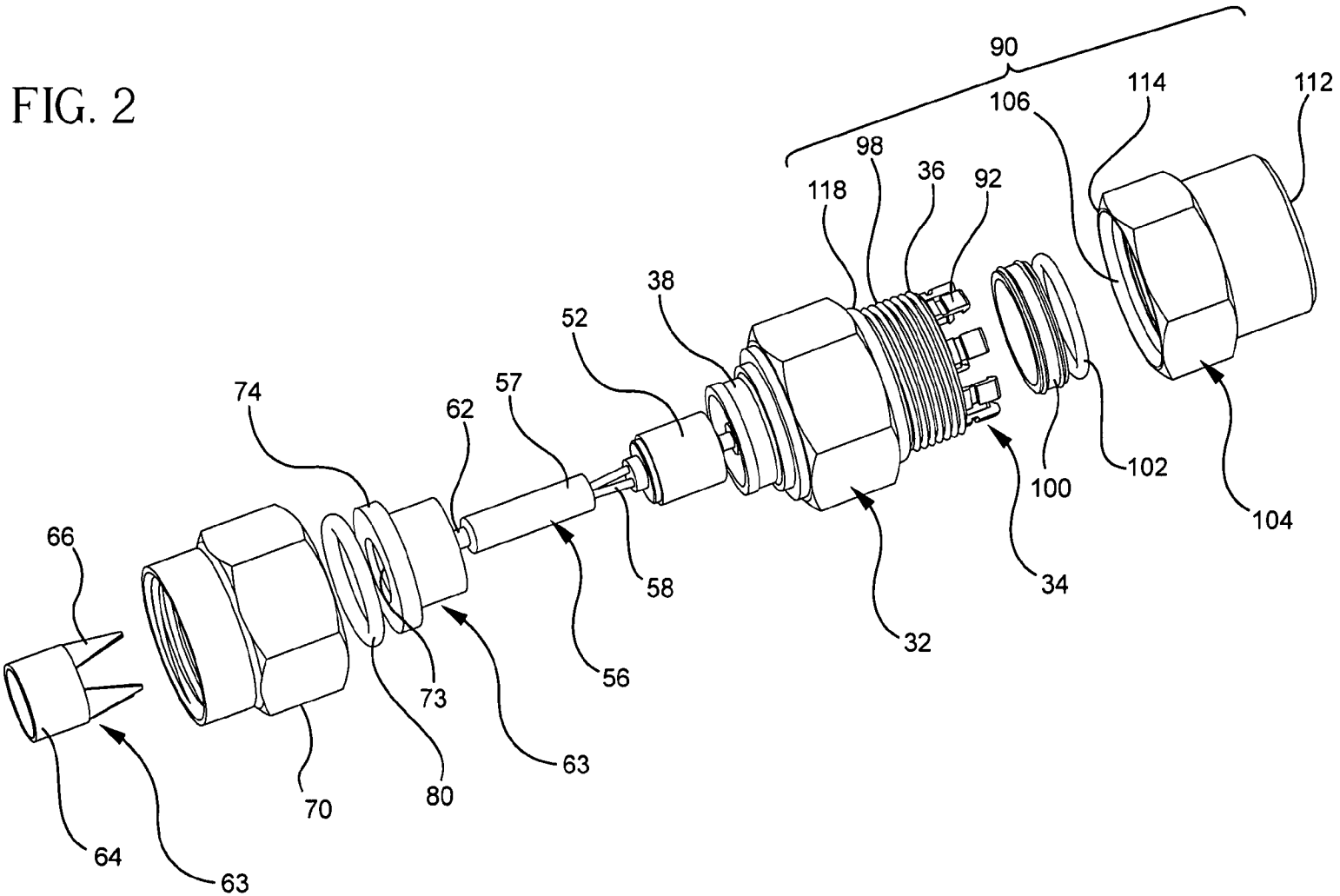
FIG. 2 is a exploded view of the present invention.
Figure 3:
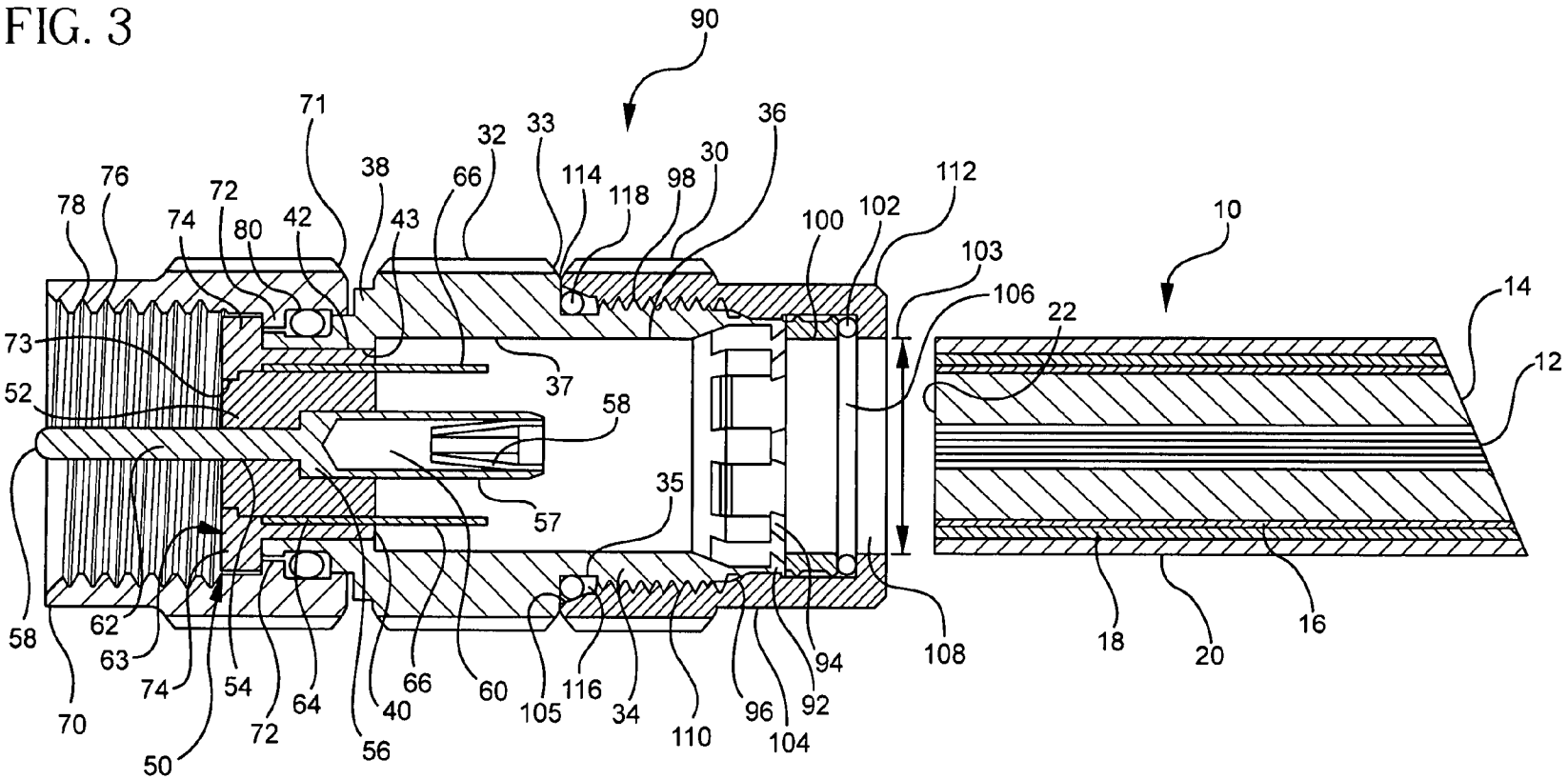
FIG. 3 is a cross section of the present invention along lines 3—3 of FIG. 1.

Referring to FIGS. 2 and 3 the connector 30 will be described in detail. A typical coaxial cable 10 is shown in FIG. 3. The cable 10 has a center conductor 12 having a dielectric covering 14 surrounding it. The dielectric layer 14 is covered by a foil 16 and a metallic braid 18. The braid 18 is then covered by an outer covering 20 which can be a rubber or insulating material. The cable 10 has a straight cut end 22 which is inserted into the connector 30. Cable 10 does not have to be specially prepared or stripped prior to inserting into the connector 30. The cut end 22 is a straight cut perpendicular to the outer covering 20.

The connector 30 has a substantially cylindrical housing 32. The housing can be made of a metallic material such as aluminum or copper that can be easily casted or extruded. Housing 32 has a first end 34 with an inner diameter 36 sized to receive the outer diameter of the cut end 22 of cable 10 with minimal amount of excess space. The housing 32 has an opposite second end 38. A rear wall 40 is positioned between the first end 34 and the second end 38. The rear wall 40 is used to allow the cable 10 to abut against it so that the cable 10 does not pass completely through the housing 32. The rear wall 40 extends from the inner surface 37 of the housing 32. An opening 42 is positioned in the center of the rear wall 40. The opening 42 is sized to accept a terminal assembly 50 for forming an electrical interface that connects the cable 10 to the mating device.

The terminal assembly 50 includes a terminal 56 inside an insulator 52. Insulator 52 is preferably circular in construction and is sized to extend through the opening 42 in the rear wall 40. Insulator 52 is made of an electrically non-conductive material. The insulator 52 has a center aperture 54 sized to allow a cylindrical terminal 56 to pass through the insulator 52. The insulator 52 is held in place in the opening 42 by a friction fit or a contact fit. However, it is envisioned that other types of connecting methods can be used. The terminal 56 has a hollow portion 60. The hollow portion 60 is sized to receive the center conductor 12 of the cable 10. The terminal 56 has a first end 57 which extends toward the first end 34 of the housing 32. First end 57 forms the opening to the hollow portion 60 of the terminal 56. Positioned within the hollow portion 60 is at least one spring contact 58 made of a resilient metallic material and is positioned to contact the center conductor 12 of the cable 10. In an alternative embodiment (not shown), the spring contact 58 can be integrally formed with the terminal 56 to create a one piece terminal. The terminal 56 has a second end 58 opposite the first end 57 which is a metal prong 62 extending toward the second end 38 of the connector 30.

The terminal assembly 50 also includes a ferrule assembly 63 that surrounds the insulator 52. The ferrule assembly 63 includes a ferrule 64 sized to fit inside a body flange 74. The body flange 74 has an inner diameter 73 that allows the ferrule 64 to fit therein. The ferrule 64 can be cylindrically shaped and positioned between the insulator 52 and the body flange 74. The body flange 74 containing the ferrule 64 and insulator 52 contacts the inner surface 43 of the opening 42 of the rear wall 40 and housing 32 to close opening 42. In an alternative embodiment (not shown), the ferrule 64 and body flange 74 can be made as a one piece unit. The ferrule 64 is made of a metallic material such as aluminum or cooper. Ferrule 64 has at least one prong 66 extending therefrom. The prongs 66 extend from the ferrule 64 toward the first end 34. The prongs 66 are positioned in a circle around the terminal 56. In a preferred embodiment, multiple prongs 66 are positioned in a circle so that they engage the braid 18 when cable 10 is inserted into the connector 30. The prongs 66 may also contact the foil 16 at the same time and preferably do not rip or tear either layer. However, if the prongs 66 do rip or tear the foil 16 and/or the braid 18, the connector 30 will still function properly. The prongs 66 preferably have a smooth outer surface to allow for easier manufacture of the connector. However, the prongs 66 can have at least one barb (not shown) used to grip the braid 18 when the cable 10 is pressed against the prong 66.

The connector 30 has first nut 70 that is used to attach the connector 30 to the mating device. The first nut 70 has a flange 72 on the first end 71 that overlaps a body flange 74 on the ferrule 64. The body flange 74 prevents the first nut 70 from disconnecting from the connector 30. The first nut 70 has an inner surface 76 with threads 78. The threads 78 are used to securely connect the first nut 70, metal prong 62, and housing 32 to the mating device. Positioned between the first nut 70 and the housing 32 is an "O" ring 80. The "O" ring 80 allows for a fluid tight seal between the first nut 70 and the housing 32 after it is properly attached to the mating device. The body flange 74 allows the first nut 70 to freely rotate about the housing 32 so that the first nut 70 can securely tighten the connector 30 against the mating device without twisting the housing 32.

The first end 34 of the housing 32 includes a compression assembly 90 that securely holds the cable 10 within the connector 30. The compression assembly 90 includes resilient tabs 92 which form the first end 34 of the housing 32. There is at least one resilient tab 92 extending from the first end 34. Each resilient tab 92 has at least one barb 94 which extends from the resilient tab 92 towards the center of the opening at the first end 34. The barbs 94 create a friction contact with the outer covering 20 of the cable 10. In a preferred embodiment, the resilient tabs 92 have a tapered outer surface 96. The tapered outer surface 96 allows a lock ring 104 to be easily inserted onto the resilient tabs 92. The lock ring 104 is attached to the first end 34 using a threaded connection. Preferably, the outer surface of the first end 34 has threads 98. The lock ring 104 has an inner cavity 106 with threads 110 on the inner surface to interface with the outer threads 98. The lock ring 104 has a hole 108 which allows the cable 10 to pass through. The hole 108 is positioned at a first end 112 of the lock ring 104. A second opposite end 114 of the lock ring 104 is sized to fit over the first end 34 of the housing 32 which allows the lock ring 104 to be threaded onto the first end 34. In a preferred embodiment, the first end 34 has a groove 116 on the outer surface which allows for a sealing ring or "O" ring 118 to be positioned therein. The "O" ring is positioned between the outer surface 35 of the first end 34 and the inner surface 105 of the cavity 106 of the lock ring 104. The "O" ring 118 allows for a fluid tight connection between the lock ring 104 and the housing 32.

In a preferred embodiment, the compression assembly 90 further includes a compression ring 100 that is placed between the first end 34 and the inside cavity 106 of the lock ring 104. The compression ring 100 can be made of a rigid plastic material. Positioned between the compression ring 100 and the inner surface 105 of the lock ring 104 is a compression sealing ring 102. The compression sealing ring 102 is used to create a fluid tight seal between the lock ring 104 and the cable 10. As the user tightens the lock ring 104 against the first end 34, the compression ring 100, and lock ring 104 compress the compression sealing ring 102. The compression sealing ring's inner diameter 103 will decrease as it is compressed by the lock ring 104 and compression ring 100, thus, forming a fluid tight seal by being compressed against the cable 10.

In order to use the present invention the user only has to push the cut end 22 of the cable 10 into the first end 34 of the connector 30. As the user pushes the cable 10 into the connector 30 the terminal 56 and the spring contacts 58 receive the center conductor 12 to create an electrical connection between the center conductor 12 and the terminal 56. At the same time the prongs 66 are forced through the braid 18 of the cable 10. As the cable 10 is pushed further into the housing 32 the cut end 22 will abut the rear wall 40 of the housing 32. The prongs 66 will be fully inserted into the braid 18 to hold the cable 10 in place. After the cable 10 is fully inserted into the housing 32 the user then threads the lock ring 104 onto the housing 32. As the lock ring 104 is tightened, the resilient tabs 92 and barbs 94 are pressed into the outer covering 20 to firmly hold the cable 10 in place. In a preferred embodiment, the housing 32 has a wall 33 extending from the outer surface. The wall 33 is positioned adjacent the threads 98 on the first end 34 of the connector 30. As the user tightens the lock ring 104, the second end 114 of the lock ring 104 will approach the wall 33. The lock ring 104 can not be inadvertently over tightened since the second end 114 will abut the wall 33 when the lock ring 104 is completely tightened.

The advantage to the current connector 30 is that a coaxial cable 10 with a straight cut end 22 can be inserted into the connector 30 without the use of any special tools or preparation of the cable 10. After the cable 10 is pushed into the connector housing 32 the center conductor 12 is automatically connected to a terminal 56 and the foil 16 and braid 18 are electrically connected to the ferrule 64 without having to strip the cable 10. A further advantage of the present invention is that the lock ring 104 securely fastens the connector 30 to the cable 10 preventing inadvertent removal of the cable 10 from the connector.

Since the present invention does not require the use of special tools to attach the connector, installation of the connector to cables is both easy and efficient and does not require extensive training.

Although the illustrative embodiment of the present invention have been described herein with reference to the accompanying drawings, it is understood that the invention is not limited to those precise embodiments and that other various changes and modifications may be effected therein by one skilled in the art without departing from the scope or spirit of the invention, and that it is intended to claim all such changes and modifications that fall within the scope of the invention.

What is claimed is:

1. A tooless connector for mounting on a straight cut end of a coaxial shielded type cable having a center conductor surrounded by a dielectric material, the dielectric material being covered by a layer of foil, the layer of foil being covered by a braided conductor with an outer non conductive outer jacket encasing the cable comprising:

a housing having a first end for receiving said coaxial shielded type cable, said first end having an inner diameter larger than the outer diameter of said coaxial shielded type cable, an oppositely positioned second end to said first end, said second end providing a passageway to said first end;

a rear wall, said rear wall positioned in an interior of said housing, said rear wall forming an abutment for the insertion of said coaxial shielded type cable;

a ferrule extending through an aperture in said rear wall to extend from said second end toward the interior of said housing and said first end;

at least one prong extending from said ferrule, said prong extending from said ferrule and positioned radially from a center of said ferrule, said at least one prong positioned to extend between said foil layer and said braided layer in the coaxial shielded type cable when said coaxial shielded type cable is inserted into said housing;

a terminal extending through the center of said ferrule, said terminal having a first end extending through said ferrule toward said first end of said housing and a second end extending toward said second end of said housing, said first end is positioned to receive the center of said coaxial shielded type cable; and a compression assembly attached to said housing for removably securing said coaxial shielded type cable in said housing.

2. A tooless connector as defined in claim 1, wherein said compression assembly further comprises:

at least one resilient tab extending from said first end of said housing;

a threaded portion on said first end, said threaded portion is on the exterior of said housing; and a lock ring, said lock ring adapted to engage said threaded portion and compress said at least one resilient tab against said coaxial shielded type cable when inserted into said housing.

3. A tooless connector as defined in claim 2, wherein said housing is cylindrically shaped.

4. A tooless connector as defined in claim 3, wherein said ferrule includes at least one prong extending therefrom having at least one external barb on said at least one prong thereon for engaging the braided layer of said coaxial shielded type cable.

5. A tooless connector as defined in claim 4, wherein said terminal first end has a hollow section with a diameter sized to receive the center conductor of said coaxial shielded type cable.

6. A tooless connector as defined in claim 5, wherein said at least one resilient tab has an inner and an opposite outer surface, said inner surface having a barb extending thereon for frictionally contacting an outer surface of said coaxial shielded type cable.

7. A tooless connector as defined in claim 6, further including at least one sealing ring positioned between the outer surface of said first end and said lock ring to provide a fluid tight seal therebetween.

8. A tooless connector as defined in claim 3, wherein said terminal first end has a hollow section with a diameter sized to receive the center conductor of said coaxial shielded type cable.

9. A tooless connector as defined in claim 8, wherein said at least one resilient tab has an inner and an opposite outer surface, said inner surface having a barb extending thereon for frictionally contacting an outer surface of said coaxial shielded type cable.

10. A tooless connector as defined in claim 9, further including at least one sealing ring positioned between the outer surface of said first end and said lock ring to provide a fluid tight seal therebetween.

11. A tooless connector for mounting on a straight cut end of a coaxial shielded type cable having a center conductor surrounded by a dielectric material, the dielectric material being covered by a layer of foil, the layer of foil being covered by a braided conductor with an outer non conductive outer jacket encasing the coaxial shielded type cable comprising:

a cylindrical housing having a first end for receiving said coaxial shielded type cable, said first end having an inner diameter larger than the outer diameter of said coaxial shielded type cable, an oppositely positioned second end to said first end, said second end providing a passageway to said first end;

a terminal assembly positioned within said cylindrical housing for creating an electrical connection with said coaxial shielded type cable said terminal assembly including a ferrule assembly extending through an aperture in said rear wall for extending from said second end toward the interior of said cylindrical housing and said first end; and a compression assembly attached to said connector to said cylindrical housing for removably securing said coaxial shielded type cable in said cylindrical housing, said compression assembly comprising at least one resilient tab extending from said first end of said cylindrical housing, and a lock ring adapted to engage said first end of said cylindrical housing to compress said at least one resilient tab against said coaxial shielded type cable when inserted into said cylindrical housing;

wherein said ferrule assembly further comprises at least one prong extending from said ferrule and positioned radially from a center of said ferrule, said at least one prong positioned to extend between said foil layer and said braided layer in the coaxial shielded type cable when said coaxial shielded type cable is inserted into said cylindrical housing.

12. A tooless connector as defined in claim 11, wherein said cylindrical housing further includes a rear wall, said rear wall positioned in an interior of said cylindrical housing, said rear wall forming an abutment for the insertion of said coaxial shielded type cable.

13. A tooless connector as defined in claim 11, wherein said ferrule assembly further includes a body flange having an inner diameter allowing the insertion of said ferrule therein, said body flange extends through said aperture in said rear wall to extend from said second end toward the interior of said cylindrical housing and said first end.

14. A tooless connector as defined in claim 13, wherein said terminal assembly further includes a terminal extending through the center of said ferrule, said terminal having a first end extending through said ferrule toward said first end of said cylindrical housing and a second end extending towards said second end of said cylindrical housing, said first end is positioned to receive the center of said coaxial shielded type cable.

15. A tooless connector as defined in claim 14, wherein said cylindrical housing further includes a threaded portion on said first end, said threaded portion is on the exterior of said cylindrical housing and said lock ring is adapted to threadedly engage said threaded portion on said first end to allow for compression of said at least one resilient tab against said coaxial shielded type cable when inserted into said cylindrical housing.

16. A tooless connector as defined in claim 15, wherein said compression assembly further comprises:

a compression ring positioned between said cylindrical housing first end and said lock ring when said lock ring is threadably engaged on said threaded portion of said first end; and a compression sealing ring positioned between said lock ring and said compression ring, wherein said compression sealing ring creates a fluid tight seal between said lock ring and said coaxial shielded type cable when said lock ring engages the threaded ring and compression ring against said compression sealing ring.

17. A tooless connector as defined in claim 16, wherein said compression sealing ring is a rubber O ring.

18. A tooless connector as defined in claim 17, wherein said compression ring is made of a rigid plastic material.

19. A tooless connector as defined in claim 19, further including a compression ring positioned between the outer surface of said first end and said at least one sealing ring to create a fluid tight seal therebetween when said lock ring engages said threaded portion on said first end.

20. A tooless connector as defined in claim 19, wherein said at least one sealing ring is made of a resilient material.

* * * * *